US005996541A

United States Patent [19]

Voigt et al.

[11] Patent Number: 5,996,541

[45] Date of Patent: Dec. 7, 1999

[54] VALVE CONTROL ARRANGEMENT FOR AN INTERNAL COMBUSTION ENGINE HAVING LIFT VALVES

[75] Inventors: Dieter Voigt; Horst-Günter Hilderts, both of Wolfsburg, Germany

[73] Assignee: Volkswagen AG, Wolfsburg, Germany

[21] Appl. No.: 08/978,001

[22] Filed: Nov. 25, 1997

[30] Foreign Application Priority Data

Nov. 29, 1996 [DE] Germany ..... 196 49 584

[51] Int. Cl.[6] ..... F01L 1/18

[52] U.S. Cl. ..... 123/90.27; 123/193.5

[58] Field of Search ..... 123/193.2, 90.27, 123/193.1, 193.3, 193.5

[56] References Cited

U.S. PATENT DOCUMENTS 3,855,981 12/1974 Loon ..... 123/90.27
4,658,770 4/1987 Okuyama et al. ..... 123/90.27
5,031,586 7/1991 Masuda et al. ..... 123/90.27
5,033,422 7/1991 Kurisu et al. ..... 123/193.5

FOREIGN PATENT DOCUMENTS 4235103 5/1993 Germany .

*Primary Examiner*—Marguerite McMahon
*Attorney, Agent, or Firm*—Baker & Botts, L.L.P.

[57] ABSTRACT

A compact, stress-orientated valve control arrangement for an internal combustion engine which is favorable from the production point of view and uses as many identical parts as possible includes a plurality of lift valves for each cylinder and pivoted valve activating levers with hydraulic supporting elements allocated to the latter, in which the geometric arrangement of the pivoted levers for the cylinder is such that the longitudinal axes of the supporting elements extend on the same side relative to the longitudinal axes of the camshafts and extend past the corresponding camshaft axis.

5 Claims, 3 Drawing Sheets

VALVE CONTROL ARRANGEMENT FOR AN INTERNAL COMBUSTION ENGINE HAVING LIFT VALVES

BACKGROUND OF THE INVENTION

This invention relates to valve control arrangements for multi-valve internal combustion engines equipped with lift valves for intake and exhaust and provided with pivoted levers for valve actuation.

U.S. Pat. No. 5,031,586 discloses an in-line internal combustion engine having three inlet valves and two exhaust valves for each combustion chamber in which pivoted levers are provided between the lift valves and cams on two camshafts. The pivoted levers have one of their ends engaging the lift valves and the other ends engaging hydraulically positioned supporting elements. The supporting elements are mounted in receptacles in the cylinder head which are supplied with oil from a lubricating system for the internal combustion engine. In this case, the valve control arrangement includes camshafts having longitudinal axes extending transversely to and between the longitudinal axes of the supporting elements for the pivoted levers and of the corresponding lift valves. For each cylinder, the exhaust valves and the inlet valves are combined into two groups. All of the supporting elements for the exhaust valves are arranged so that their longitudinal axes, as viewed in the longitudinal direction of the exhaust valve camshaft, lie on the outside of the plane of the exhaust valves relative to the longitudinal center plane of the cylinder head. Similarly, on the other side of the longitudinal center plane of the cylinder head, the plane of the supporting elements for the two intake valves is on the outside of the plane of the valves relative to the center plane of the cylinder head. The third intake valve for each cylinder is centrally located and the hydraulic supporting elements for those valves are located adjacent to the longitudinal center plane of the cylinder head so that their longitudinal axes are inside the planes of longitudinal axes of the other valves. The three supporting elements of the intake valves for each cylinder are therefore arranged in a zigzag pattern in the longitudinal direction of the cylinder head.

Furthermore, German Offenlegungsschrifft No. 42 35 103 discloses a valve control arrangement in which hydraulic supporting elements are integrated coaxially in the pivoted levers for the lift valves and the levers are mounted on pivots. In this valve control, the geometric pattern is arranged so that, as viewed in the longitudinal direction of each camshaft, the longitudinal axis of the camshaft is located between the longitudinal axis of a lift valve and a longitudinal axis parallel thereto extending through the lever pivot, whereas the longitudinal axis of the camshaft for the cylinder lying adjacent thereto is located outside the region between these two parallel longitudinal axes.

SUMMARY OF THE INVENTION

Accordingly, it is an object of the present invention to provide a valve control arrangement for an internal combustion engine which overcomes disadvantages of the prior art.

Another object of the invention is to provide a valve control arrangement for a multicylinder internal combustion engine having lift valves and having pivoted valve control levers in which the controls for the lift valves are combined in groups in as simple a geometric manner as possible to permit as simple a production of the valve control arrangement as possible and the use of the same type of components as far as possible. In addition, the oil supply required when using hydraulic supporting elements is provided in a comparatively simple manner.

These and other objects of the invention are attained by providing, for each cylinder, one group of lift valves of the same type supported on supporting elements having longitudinal axes which extend outside, relative to a longitudinal center plane of the cylinder head, the longitudinal axes of the supporting elements of an adjacent cylinder in the longitudinal direction which are allocated to the same valve group for that cylinder being on the inside of the axes of the lift valves relative to the longitudinal center plane. In simple terms, this valve control arrangement has a cylinder head region allocated to each cylinder which is in each case symmetrical to the longitudinal center plane of the cylinder head while retaining the positions of the camshafts relative to adjacent cylinders, i.e. the configuration is arranged so as to be rotated through 180° in the parting plane between cylinder head and the engine block.

In this way, the location of the longitudinal axes of the camshafts between the longitudinal axes of the supporting elements and of the lift valves, which is required for an advantageous force transmission between the camshaft and the pivoted levers, is retained for all cylinders and all lifting valves. At the same time, the configuration of the pivoted levers and supporting elements within a group of valves of the same type for each cylinder is identical. This results in an especially simple drilling pattern for production due to the parallel arrangement of the longitudinal axes of the supporting elements and lift valves. Moreover, the position of the receptacles for the supporting elements, which does not alternate within a group of lift valves of the same type, permits a comparatively simple supply arrangement for pressure oil or lubricating oil.

In an especially preferred embodiment, the valve control arrangement is suitable for internal combustion engines having cylinder axes which do not lie in a single plane, i.e. cylinder axes which are either disposed in a V-shape relative to one another or are arranged in two rows parallel to one another. In such cases, the cylinder rows are comparatively close to one another or are crossed over into one another, so that either a so-called VR arrangement or a two-row internal combustion engine having, for example, one crankshaft, results.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 3:
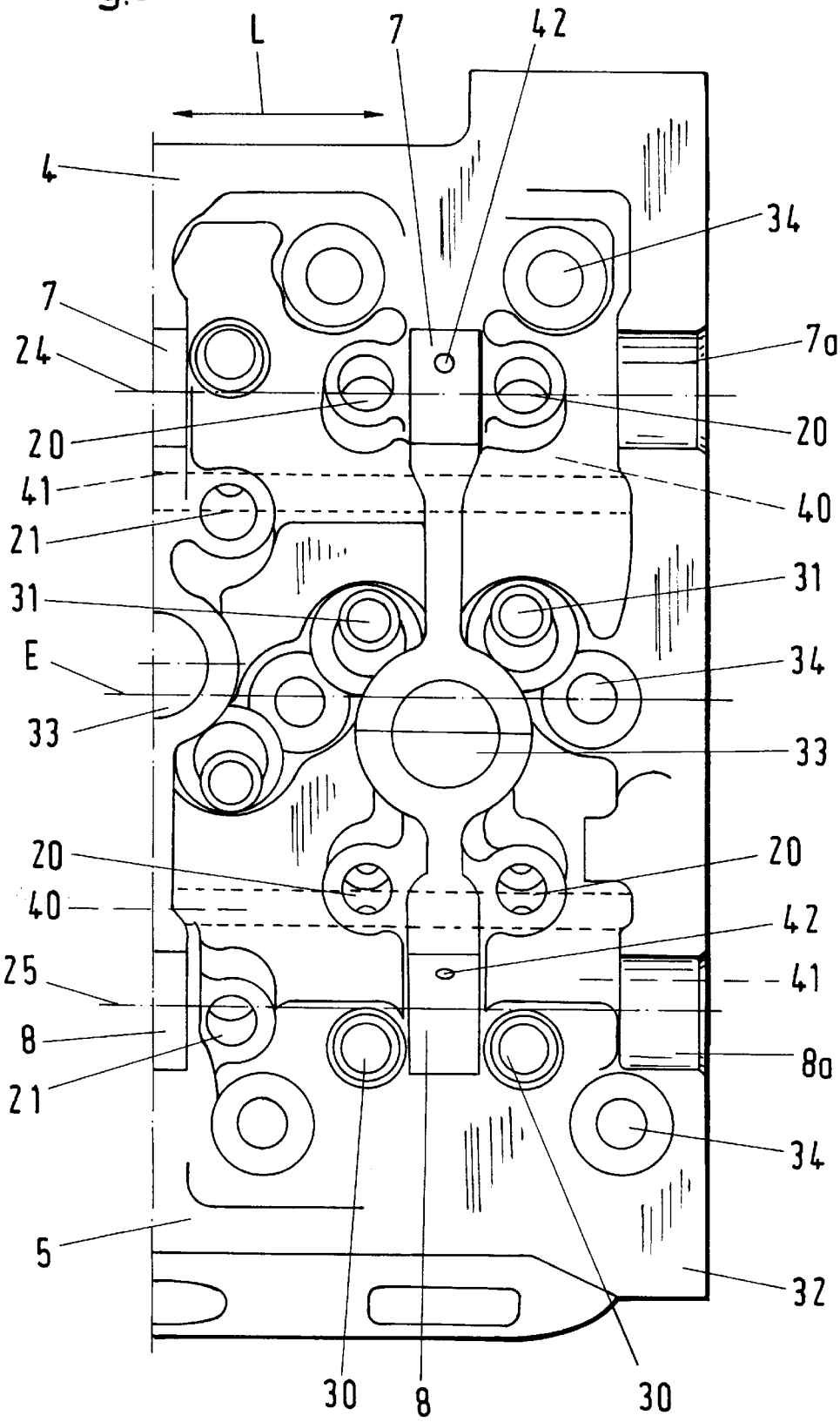
FIG. 3 is a plan, view of part of the cylinder head without the valve control components shown in FIGS. 1 and 2.

In the typical embodiment of the invention shown in the drawings, a cylinder head 1 of a multi-cylinder internal combustion engine has a combustion chamber surface 2 which faces an engine block (not shown) and has combustion chambers 3 partly formed therein spaced in the longitudinal direction L (FIG. 3). The cylinder head 1 is defined by lateral walls 4 and 5 which in turn have a bearing surface 6 extending parallel to the combustion-chamber surface 2.

The cylinder head has a longitudinal center plane E containing the longitudinal axis of a crankshaft (riot shown) and has bearings 7 and 8 for camshafts 9 and 10, the bearings being formed in mirror image relation to each other in the bearing surface 6. The camshafts 9 and 10 each carry cams 11 and 12 which act through pivoted levers 14 and 15 to control operation of corresponding exhaust lift valves 16 and intake lift valves 17.

The combustion chambers 3 of adjacent cylinders of the engine are arranged at equal distances from and on opposite sides of the longitudinal center plane E in the longitudinal direction L, so that the internal combustion engine may be referred to as a two-row internal combustion engine having a cylinder head 1 common to both rows. The lift valves 16 and 17 for each cylinder which act in the same manner are combined in two groups $G_{16}$ and $G_{17}$, respectively. In this example, two exhaust lift valves 16 are allocated to the group $G_{16}$, and two intake lift valves 17 are allocated to the group $G_{17}$. The lift valves 16 or 17 in each group $G_{16}$ or $G_{17}$ are arranged parallel to one another and in one plane.

Corresponding to this group arrangement, two cams 11 and two cams 12 for each cylinder of the internal combustion engine are arranged on each of the camshafts 9 and 10, respectively. The pivoted levers 14 and 15 engaged by these cams 11 and 12 each have one of their ends engaged by the lift valves 16 and 17 while the other opposite end of each lever is supported on a corresponding hydraulic supporting element 18 or 19 containing a valve-clearance-compensating device. The supporting elements 18 and 19 are retained in corresponding receptacles 20 and 21 in the cylinder head 1 which are supplied with oil from a lubricating system of the internal combustion engine.

Two longitudinal axes 22 of the lift valves 16 and 17, respectively, are disposed parallel to corresponding longitudinal axes 23 of the supporting elements 18 and 19, the longitudinal axes 24 and 25 of the camshafts 9 and 10 in each case extending transversely to and between the longitudinal axes 22 and 23 of the pivoted levers 14 and 15. Consequently, the receptacles 20 and 21, respectively, have axes parallel to corresponding bores 30 and 31 in the cylinder head 1 which accommodate valve guides 26 for the valves 17 and 16 respectively.

In addition, seat rings 27, valve-spring retainers 28 and valve springs 29 are provided for the lift valves 16 and 17 in a conventional manner.

Figure 1:
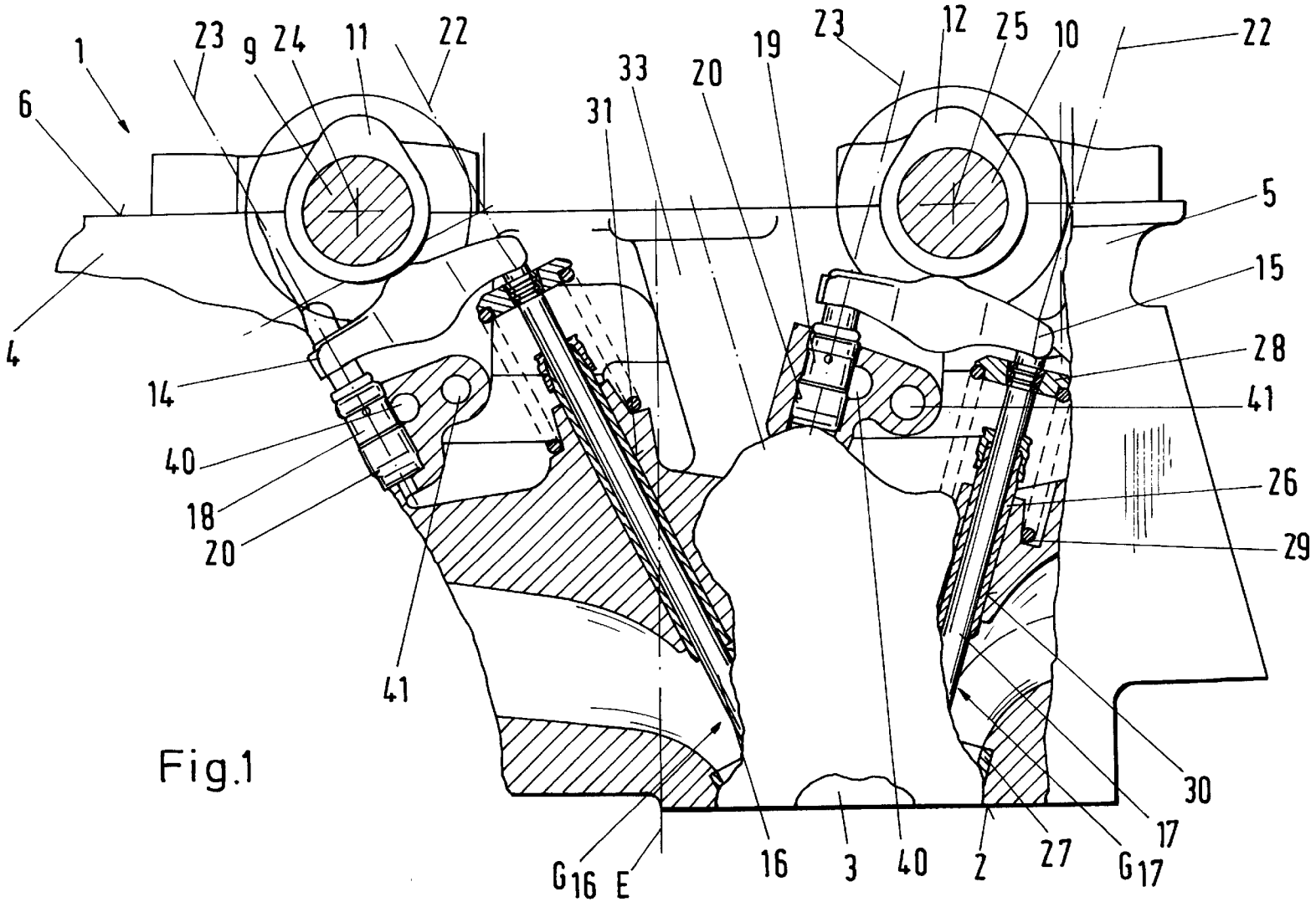
FIG. 1 is a cross-sectional view illustrating a representative embodiment of a valve control arrangement according to the invention in the region of a combustion chamber.
Figure 2:
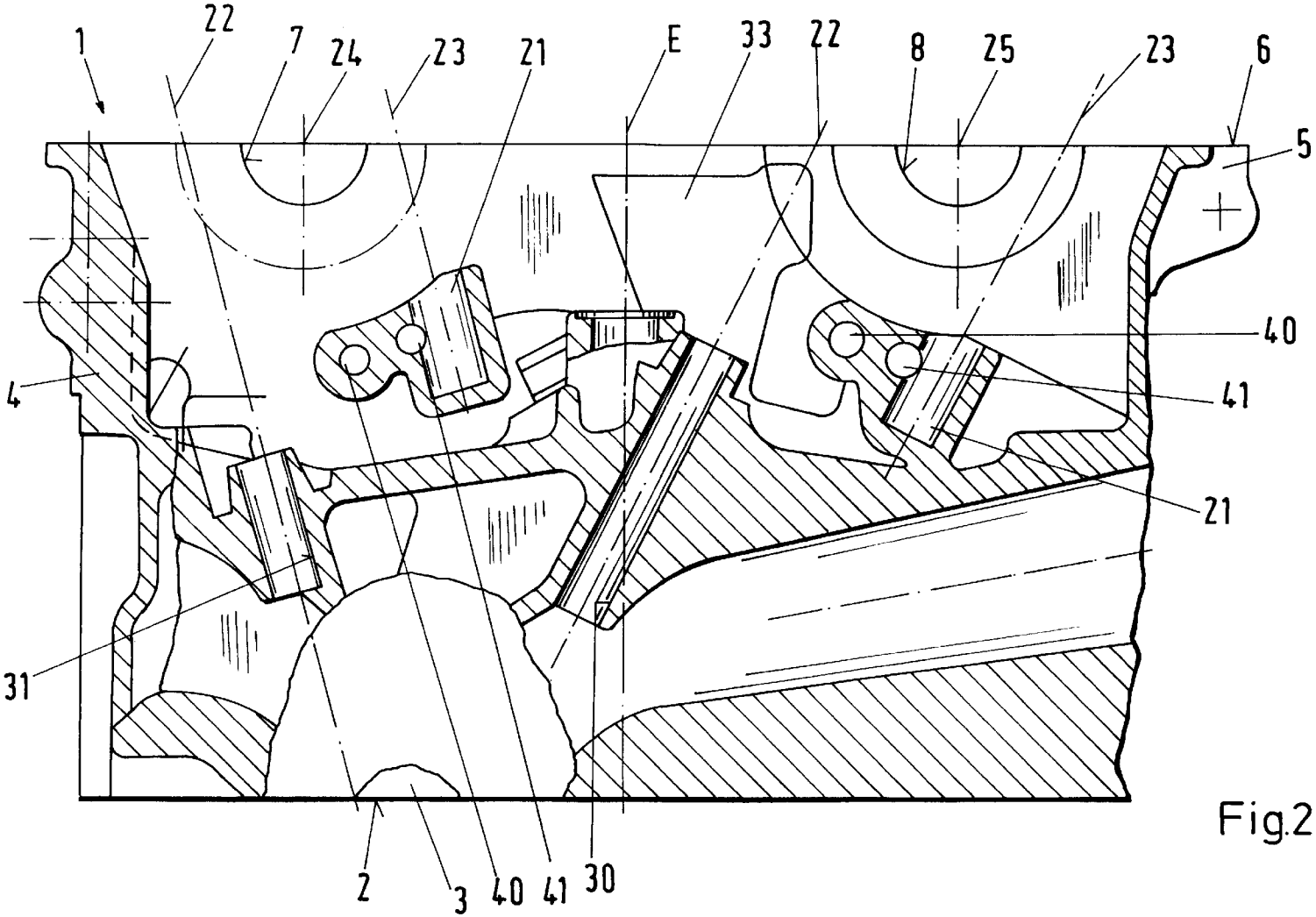
FIG. 2 is a cross-sectional view through a cylinder head omitting the valve control components mounted in the region of a second combustion chamber adjacent to the combustion chamber shown in FIG. 1.

As can best be seen from FIG. 1, two lift valves of comparatively short construction and two lift valves of comparatively long construction are associated with each combustion chamber 3. In the arrangement shown in FIG. 1, the short lift valves 17 control the intake and long lift valves 16 control the exhaust for those combustion chambers 3 which are adjacent to the wall 5. The combustion chamber 3 of the next cylinder which is adjacent to the combustion chamber 3 shown in FIG. 1, is arranged adjacent to the wall 4 shown in FIG. 2. The combustion chambers 3 adjacent to the wall 4 each have two lift valves 17 controlling the intake which are of comparatively long construction and are inserted together with their valve guides 26 in bores 30, and also have two lift valves 16 controlling the exhaust which are of comparatively short construction and are mounted with their valve guides 26 in corresponding bores 31.

Because of these differences in the position and length of the lift valves 16 and 17 actuated by the camshafts 9 and 10, the position of the receptacles 20 of a particular cylinder shown in FIG. 1 is arranged in such a way that the longitudinal axes 23 of the supporting elements 18 and 19 are in each case on the left of the corresponding longitudinal axis 24 or 25 of the camshafts 9 and 10.

For a cylinder adjacent to the cylinder shown in FIG. 1, the receptacles 21, because of the different position and length of the lift valves 16 and 17, are each arranged in such a way that the longitudinal axes 23 of the supporting elements 18 and 19 extend on the right past the corresponding longitudinal axis 24 or 25 of the camshafts 9 and 10.

For example, for the camshaft 9 controlling the exhaust valves, the two receptacles 20 lying on the inside of the valve axes relative to the longitudinal center plane E are arranged along this camshaft 9, and for the cylinder adjacent to the cylinder shown in the drawings, the receptacles 21 are arranged on the outside of the valve axes relative to the center plane E. Furthermore, it can be seen from FIG. 3 that central bearings 7 and 8 for the camshafts 9 and 10 respectively are each arranged between two of the receptacles 20 for each cylinder. FIG. 3 also shows end bearings 7*a* and 8*a* formed in an end-face wall 32 of the cylinder head 1, a space 33 closely adjacent to the longitudinal center plane E for accommodating a spark plug or a fuel-injection device, and through-bores 34 for accommodating cylinder-head screws (not shown).

The requisite pressure- and lubricating-oil supply to the supporting elements 18 and 19 and the bearings 7, 7*a*, 8 and 8*a* is provided essentially by a total of four oil passages 40 and 41 passing through the cylinder head 1 in the longitudinal direction L. These oil passages 40 and 41 are supplied with oil from an intake in a manner not shown and the oil flows through all of them in the same direction. In the arrangement of oil passages shown in FIG. 1, the passages 40 lying on the left supply oil to the supporting elements 18 and 19 in the receptacles 20 and, in the passages 41 supply the oil to the receptacles 21 on the right and to the supporting elements 18 and 19 held therein. In the region of the bearings 7 and 7*a* and 8 and 8*a*, respectively, bores 42 shown in FIG. 3 are connected in each case to the oil passage 40 or 41 which is on the outside relative to the longitudinal center plane E to supply the requisite lubricating oil thereto.

Although the invention has been described herein with reference to a specific embodiment, many modifications and variations therein will readily occur to those skilled in the art. Accordingly, all such variations and modifications are included within the intended scope of the invention.

We claim:

1. A valve control arrangement for an internal combustion engine having a plurality of cylinders comprising a cylinder head, a plurality of lift valves supported in the cylinder head, a plurality of camshafts supported on the cylinder head, a plurality of pivoted levers supported on the cylinder head, a plurality of hydraulic supporting elements received in receptacles in the cylinder head which are supplied with oil from a lubricating system, the camshafts having longitudinal axes which extend transversely to and between the longitudinal axes of the supporting elements for pivoted levers of the corresponding lift valves, the lift valves for each cylinder being arranged in a first group controlling the intake to the cylinder and a second group controlling the exhaust from the cylinder, wherein the hydraulic supporting elements which are associated with the valves of one of the two groups of valves for one of the cylinders have longitudinal axes which extend on one side of the longitudinal axis of the corresponding camshaft and the hydraulic supporting elements associated with the valves of the same group for the adjacent cylinder have longitudinal axes which extend on the other side of longitudinal axis of the corresponding camshaft as viewed in the same direction.

2. A valve control arrangement according to claim 1 wherein axes of adjacent cylinders extend in a V-shape relative to each other and the cylinder head covers all of the combustion chambers of the plurality of cylinders.

3. A valve control arrangement according to claim 1 wherein the longitudinal axes of a supporting element and of a lift valve associated with a pivoted lever extend parallel to each other.

4. A valve control arrangement according to claim 1 wherein the longitudinal axes of the lift valves in each of the groups extend parallel to each other in a common plane.

5. A valve control arrangement according to claim 1 wherein all of the hydraulic supporting elements for the pivoted levers engaging the valves associated with any cylinder have longitudinal axes which extend on the same side of the corresponding camshafts when viewed in the same direction.

* * * * *